United States Patent [19]

Pellew

[11] Patent Number: 4,996,827

[45] Date of Patent: Mar. 5, 1991

[54] HEADPLATE AND TREE SYSTEM FOR A SADDLE

[75] Inventor: Peter I. Pellew, Sherborne, United Kingdom

[73] Assignee: Wellep International (UK), Limited, Sherborne, United Kingdom

[21] Appl. No.: 308,651

[22] Filed: Feb. 9, 1989

[30] Foreign Application Priority Data

Feb. 11, 1988 [GB] United Kingdom ..... 8803099
Feb. 18, 1988 [GB] United Kingdom ..... 8803848

[51] Int. Cl.[5] ..... B68B 1/00
[52] U.S. Cl. ..... 54/44; 54/37
[58] Field of Search ..... 54/37, 44, 40, 42

[56] References Cited

U.S. PATENT DOCUMENTS

| | | | |
|---|---|---|---|
| 6,472 | 5/1849 | Rhoades et al. | 54/44 |
| 6,682 | 8/1849 | Smith | 54/44 |
| 8,064 | 4/1851 | Smith | 54/44 |
| 11,068 | 6/1854 | Jones | 54/44 |
| 38,404 | 5/1863 | Nichols | 54/44 |
| 320,522 | 6/1885 | Wirt | 54/44 |
| 821,135 | 5/1906 | Szameitat | 54/44 |
| 1,246,675 | 11/1917 | Stewart | 54/44 |

*Primary Examiner*—John G. Weiss
*Attorney, Agent, or Firm*—Pearne, Gordon, McCoy & Granger

[57] ABSTRACT

The headplate and tree system for a saddle in which the headplate is suitable to form part of the tree of a saddle. The headplate includes a first plate member intended in use to lie on one side of the withers and a second plate member intended to lie on the other side of the withers. The second plate member is directly or indirectly connected to the first plate member for pivotal movement with respect thereto. An adjustable lock is provided capable of securing the first plate member relative to the second plate member at different angles with respect to each other. Also disclosed is a saddle tree which incorporates the headplate and a saddle which incorporates the tree. The headplate makes it possible for the same saddle to fit horses of different sizes.

9 Claims, 2 Drawing Sheets

HEADPLATE AND TREE SYSTEM FOR A SADDLE

This invention relates to a headplate suitable to form part of a tree of a saddle, and to a tree incorporating the headplate, as well as a saddle incorporating the tree.

BACKGROUND OF THE INVENTION

In construction of saddles for horse-riding, a frame which is known as a tree is used. This tree may be made of a single piece, which is generally wood, although any other suitable strong material such as composites may be used, and such a tree is known as a "fixed tree". Alternatively the tree may be made more flexible by the use of laminated strips of wood, or again other materials such as composites, which are generally reinforced by lengths of metal, such trees being known as "spring trees".

Some trees, especially conventional spring trees, include a gullet plate, which is also known as a headplate, and which comprises two arcuate plates, commonly of metal, one of which overlies the other, and which are fixed together sandwiching another component of the tree in the pommel area. These plates serve to reinforce the saddle tree in this area.

A conventional spring tree also includes two spring members, commonly strips of metal, which extend from the headplate area of the tree to the cantle area. These spring members govern flexion of the saddle in the seat area.

To complete the construction of the saddle a covering, which is known as flocking and generally consists of leather and padding, is then fitted around the saddle tree.

Conventionally, only a few sizes of tree are available, so the flocking is used to compensate for any difference in shape and size between the horse's withers and the saddle tree. Thus a considerable amount of padding is necessary in this area, which reduces the sensitivity of contact between the rider and the horse. Also, the flocking settles within a few hours of use to fit the shape and size of a particular horse at a particular time, and thereafter may not be varied. Therefore a separate saddle will be needed for each horse, and even this may not fit perfectly all the time, since the shape and size of the horse's withers may vary, for instance with the season.

After construction, the stiffness of the spring members in the seat area is also fixed. Thus the saddle will not be suitable for use by riders of widely varying weights, since each will require a different degree of tension in the springs, to protect the horse's back whilst allowing sufficient contact with the rider.

SUMMARY OF THE INVENTION

According to a first aspect of the present invention, there is provided a headplate suitable to form part of a tree of a saddle, the headplate comprising:

a first plate member intended in use to lie on one side of the withers;

a second plate member intended in use to lie on the other side of the withers, the second plate member being directly or indirectly connected to the first plate member and being able to undergo pivotal movement with respect thereto; and adjustable fixing means capable of securing the first plate member relative to the second plate member at different angles relative to each other.

Preferably, the two plate members are directly pivotally connected, although there may be several pivotally connected members. The plate members may conveniently be connected by means of a hinge.

Each plate member is preferably provided with an end region remote from the hinge means which extends to form a point, and with an auxiliary plate portion which overlies that portion which includes the end region which forms the point. Thus, the plate members are preferably formed so that their major part is of the same shape as the conventional headplate; that is, two portions of each plate member extend from the hinge area to lie above and below, and thereby to sandwich in the pommel area, another major component of the tree which extends from the pommel area to the cantle area.

To provide rigidity in the headplate, each plate member is preferably formed by casting.

The fixing means is preferably a screwthreaded member, rotation of which causes the plate members to pivot relative to each other. This member may be provided on one end region with a right handed screwthread and on the other end region with a left handed screwthread. These ends may then engage with screwthreaded means associated with each headplate member, so that rotation of the fixing means causes the plates to move inwards together or outwards together.

The screwthreaded means associated with each plate member may be in the form of barrels which are located in apertures in the plate members and may rotate. This compensates for the relative change in the position of the plate members. Access to the screwthreaded member may be provided, for example, by an axial extension which passes through a hole in one of the plate members of the tree, but the screwthreaded member is preferably provided with radially extending holes in its central portion, into which may be inserted the point of a tool which may be used to turn the screwthreaded member.

If there is more than one pivot axis, such fixing means may be used at any of them or any other suitable type of fixing means may also be used.

According to a preferred embodiment of a spring tree of the invention, there is provided means for varying the tension of the spring members of the spring tree. This may be achieved by the provision of adjustable means capable of causing movement of the spring members in a manner such as to vary the tension therein. This may conveniently be achieved by fixing the spring members at one end region, having a pivoting point at an intermediate portion, and providing means by which the other end region of the spring member may be moved towards or away from the rest of the saddle tree. This movement may be achieved for example by means of a screwthreaded member which may be turned by inserting a coin into a slot at one end of that member.

According to a second aspect of the invention, there is provided a saddle tree including the headplate according to the first aspect of the invention. This tree may be a fixed tree, but is preferably a spring tree.

According to a third aspect of the invention, there is provided a saddle having as its core a saddle tree according to the second aspect of the invention.

BRIEF DESCRIPTION OF THE DRAWINGS

For a better understanding of the invention, and to show how it may be carried into effect, reference will now be made, by way of example, to the drawings, in which.

DETAILED DESCRIPTION OF THE DRAWINGS

Figures 1, 2:
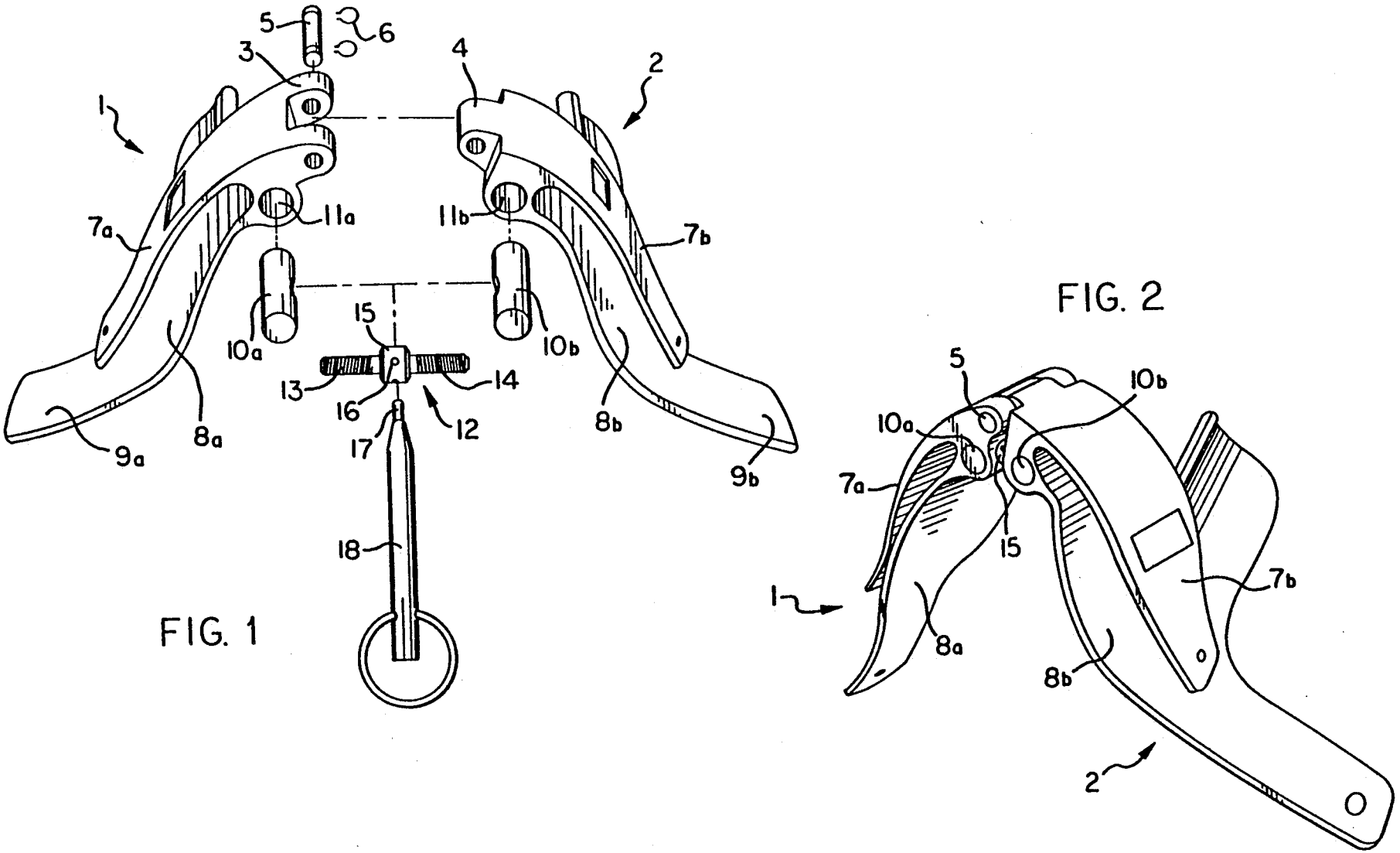
FIG. 1 is an exploded view of one embodiment of a headplate according to the present invention.
FIG. 2 is a perspective view of the assembled headplate of FIG. 1.

FIG. 1 shows first and second plate members 1 and 2, which are substantially mirror images of each other. The plate members 1 and 2 are provided at a first end with respective protrusions 3 and 4 which constitute hinge components and fit together to receive a hinge pin 5. The hinge pin 5 is provided with circular clips 6 at each end which serve as detents to secure the hinge pin 5. Portions 7*a*, 8*a* and 7*b*, 8*b* extend from the hinge means 3 and 4 of each plate member 1 and 2, the portions 7*a* and 7*b* overlying, and being spaced from, the portions 8*a* and 8*b*. The portions 8*a*, 8*b* further extend to form what are known as points 9*a*, 9*b*.

Barrels 10*a*, 10*b* each having a radial internal screwthread are rotatably received in apertures 11*a*, 11*b* on the plate members 1 and 2. A screwthreaded pin 12 is provided at one end portion with a left handed screwthread 13 and at the other end portion with a right handed screwthread 14, which are inserted into the barrels 10*a*, 10*b* through openings in the respective plate members 1 and 2. A raised central portion 15 on the screwthreaded pin 12 is provided with radially extending apertures 16 which may receive the end 17 of a tool 18.

Figure 3:
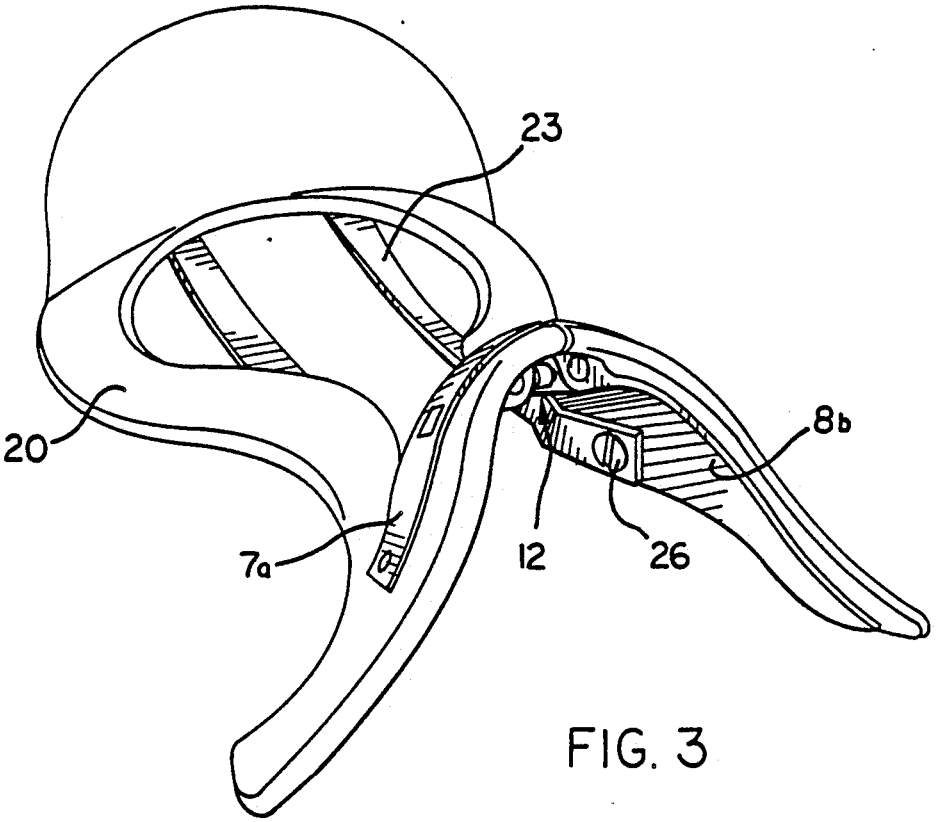
FIG. 3 is a view of the complete saddle tree incorporating the headplate of FIG. 2.
Figure 4:
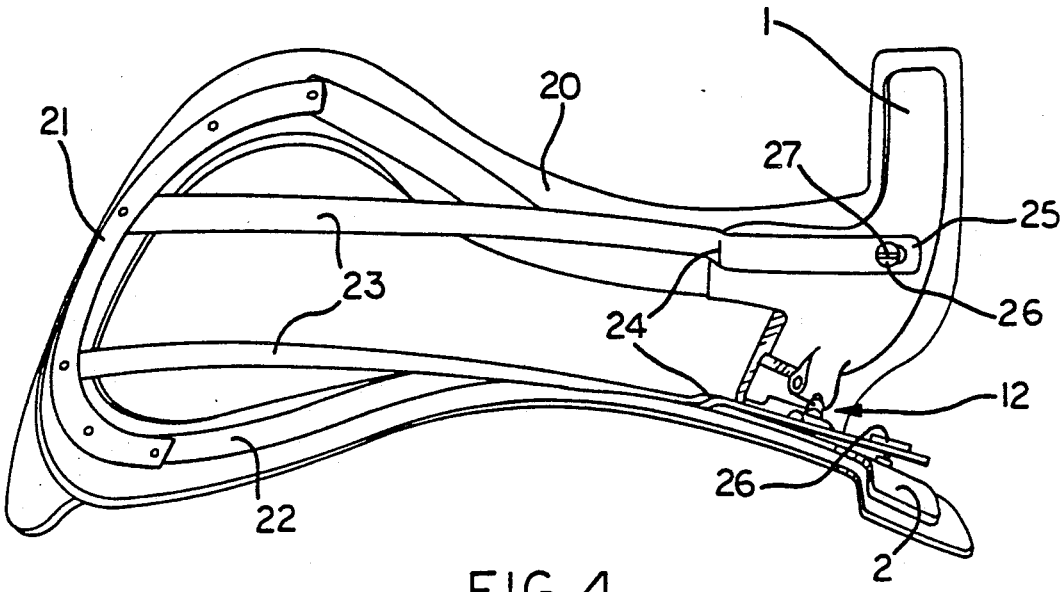
FIG. 4 is another view of the complete saddle

Referring now to FIG. 3, the headplate when incorporated in a saddle tree serves to reinforce the main component 20 of the saddle tree in the pommel area. Portions 7*a* and 8*a*, and 7*b* and 8*b*, of each plate member sandwich the component 20 and are fixed to it. The component 20 is also reinforced, as shown in FIG. 4, by an arcuate member 21 at the cantle area and by two members 22 extending from the arcuate member 21 towards the plate members 1 and 2.

Two elongate spring members 23 are attached at one end region to the arcuate member 21 at the cantle end of of the saddle tree. The spring members 23 are bent at intermediate points 24, which rest against the headplate members 1 and 2 and serve as pivotal points. At the other end region 25 they are attached to the headplate members 1 and 2, by means of screws 26 which extend through the spring members 23 into the plate members 1 and 2.

In use, the spring tree is covered by flocking, with a top coat of leather. The covering may be drawn apart to provide access to the screwthreaded pin 12. The point 17 of the tool 18 is inserted into the radially extending apertures 16, and the tool 18 is then used to turn the screwthreaded pin 12, which causes the plate members 1 and 2 to move inwards together or to move outwards together. This action either reduces or enlarges the angle of the pommel area of the saddle, thus allowing adjustment of the saddle to fit the horse's withers.

The flocking may also be parted to provide access to the screws 26. Each screw 26 may be adjusted by inserting a coin into a slot 27 on the head of the screw 26. Tightening the screw 26 will cause the end 25 of the spring member 23 to move towards the respective plate member, and thus the spring member 23 will bend between the pivotal point 24 and the cantle end to provide a firmer seat. Conversely undoing the screws 26 will allow the end 25 of the spring member 23 to move away from the respective plate member and thus the spring member 23 will return to a straighter position, giving a less firm support.

What is claimed is:

1. A headplate suitable to serve as reinforcement for a head of a tree of a saddle, the headplate comprising:

a rigid first member intended in use to lie on one side of the withers, the first member having an upper plate intended to overlie part of one side of the head and rigidly spaced from a lower plate, said lower plate intended to underlie part of the one side of the head;

a rigid second member intended in use to lie on the other side of the withers, the second member having an upper plate intended to overlie part of the other side of the head and rigidly spaced from a lower plate, said lower plate intended to underlie part of the other side of the head, the second member being connected to the first member and being able to undergo pivotal movement with respect thereto; and compact, instantly adjustable fixing means capable of securing the first member relative to the second member at an infinitely variable angle over a predetermined range, the fixing means including a screwthreaded member having a first end region which is provided with a right-handed screwthread and a second end region which is provided with a left-handed screwthread, which screwthreads engage with barrel nuts located in apertures located in the first and second members respectively, so that rotation of the screwthread member causes the first and second members to move inward together and outward together.

2. A headplate as claimed in claim 1, in which the first and second members are directly connected to each other in a pivotable manner.

3. A headplate as claimed in claim 2, in which the first and second members are provided with hinge means which are connected in a pivotable manner by a pin which extends through the hinge means.

4. A headplate as claimed in claim 1, in which an intermediate portion of the screwthreaded member is provided with a plurality of radially extending holes into which may be inserted the point of a tool in order to turn the screwthreaded member.

5. A headplate as claimed in claim 1, in which access to the screwthreaded member is provided by an axial extension which passes through a hole in one of the first and second members.

6. A reinforced tree for a saddle comprising a headplate including:

a rigid first member intended in use to lie on one side of the withers, the first member having an upper plate intended to overlie part of one side of the head and rigidly spaced from a lower plate, said lower plate intended to underlie part of the one side of the head;

a rigid second member intended in use to lie on the other side of the withers, the second member having an upper plate intended to overlie part of the other side of the head and rigidly spaced from a lower plate, said lower plate intended to underlie part of the other side of the head, the second member being connected to the first member and being able to undergo pivotal movement with respect thereto; and compact, instantly adjustable fixing means capable of securing the first member relative to the second member at an infinitely variable angle over a predetermined range, the fixing means including a screwthreaded member having a first end region which is provided with a right-handed screwthread and a second end region which is provided with a left-handed screwthread, which screwthreads engage with barrel nuts located in apertures located in the first and second members respectively, so that rotation of the screwthreaded member causes the first and second members to move inward together and outward together.

7. A reinforced tree as claimed in claim 6, which is a spring tree having spring members.

8. A reinforced three as claimed in claim 7, which also includes means for varying the tension of the spring members of the spring tree, these means being capable of causing movement of the spring members in a manner such as to vary the tension therein.

9. A saddle comprising a reinforced tree, said reinforced tree including:

a rigid first member intended in use to lie on one side of the withers, the first member having an upper plate intended to overlie part of one side of the head and rigidly spaced from a lower plate, said lower plate intended to underlie part of the one side of the head;

a rigid second member intended in use to lie on the other side of the withers, the second member having an upper plate intended to overlie part of the other side of the head and rigidly spaced from a lower plate, said lower plate intended to underlie part of the other side of the head, the second member being connected to the first member and being able to undergo pivotal movement with respect thereto; and compact, instantly adjustable fixing means capable of securing the first member relative to the second member at an infinitely variable angle over a predetermined range, the fixing means including a screwthreaded member having a first end region which is provided with a right-handed screwthread and a second end region which is provided with a left-handed screwthread, which screwthreads engage with barrel nuts located in apertures located in the first and second members respectively, so that rotation of the screwthreaded member causes the first and second members to move inward together and outward together.

* * * * *